United States Patent [19]

Clayton

[11] 4,075,976

[45] Feb. 28, 1978

[54] APPARATUS FOR CURTAIN COATING OBJECTS

[75] Inventor: A. Wiley Clayton, 1428 Maxwell Lane, Upland, Calif. 91786

[73] Assignee: A. Wiley Clayton, Upland, Calif.

[21] Appl. No.: 728,336

[22] Filed: Sep. 30, 1976

Related U.S. Application Data

[63] Continuation-in-part of Ser. No. 448,017, Mar. 4, 1974, abandoned.

[51] Int. Cl.[2] ..... B05C 5/00

[52] U.S. Cl. ..... 118/324; 118/DIG. 4; 427/420

[58] Field of Search ..... 118/300, 324, 325, 326, 118/DIG. 4; 427/420

[56] References Cited

U.S. PATENT DOCUMENTS

| | | | |
|---|---|---|---|
| 1,200,065 | 10/1916 | Yingling | 118/DIG. 4 |
| 2,784,697 | 3/1957 | Uhleen | 118/325 X |
| 3,067,060 | 12/1962 | Glaus | 118/324 X |
| 3,074,374 | 1/1963 | Burkle | 118/DIG. 4 |
| 3,205,089 | 9/1965 | Kinzelman | 118/DIG. 4 |
| 3,341,354 | 9/1967 | Woods et al. | 118/324 X |
| 3,587,527 | 6/1971 | Perry | 118/324 |
| 3,632,374 | 1/1972 | Greiller et al. | 118/324 X |
| 3,802,387 | 4/1974 | Perry et al. | 118/324 |

FOREIGN PATENT DOCUMENTS

| | | | |
|---|---|---|---|
| 1,415,447 | 9/1965 | France | 118/DIG. 4 |

*Primary Examiner*—Mervin Stein
*Attorney, Agent, or Firm*—Frank D. Gilliam

[57] ABSTRACT

Curtain coater apparatus is disclosed for coating objects wherein the coater head is maintained substantially full of coating material, the material is discharged through an elongated adjustable orifice at a rate to form a stable or unbroken curtain, and an object is conveyed through the curtain at a velocity to deposit a layer of the material of pre-determined thickness onto the object. The heat is provided with a longitudinally split, resilient, metallic, tubular member, with orifice knives carried thereby along the split, one knife being movable by hydraulic actuators with respect to the other knife to define the elongated adjustable orifice. A crank and rack arrangement, carried by the head, is used to adjust the stroke of the hydraulic actuators, and thereby to regulate the orifice width. The tubular member is provided with an elongated filler tube that has a trough in its upper quadrant to distribute the material evenly throughout the entire length of the tubular member, thus reducing turbulence near the entry. The filler tube and the tubular member form passages therebetween, which provide for an increased speed of the material as it approaches the orifice, thereby reducing precipitation of solids. The ends of the tubular member are sealed by end assemblies that accommodate to the changing shape of the tubular member. Windscreens surround the head to protect the curtain. Hydraulic cylinder apparatus is provided which can raise, lower, and level the head longitudinally, and laterally. A narrow receptacle, which minimizes the amount of material used in the coater, and aids in the conveying of small objects, is provided on the conveyor. An hydraulic drive system is utilized to control the curtain coater.

35 Claims, 14 Drawing Figures

APPARATUS FOR CURTAIN COATING OBJECTS

This is a continuation-in-part of application Ser. No. 448,017 filed Mar. 4, 1974 now abandoned.

BACKGROUND OF THE INVENTION

1. Field of the Invention

The invention relates to curtain coater apparatus and more particularly, to apparatus for coating objects with fluid material by passing the objects through a curtain of the material.

2. Description of the Prior Art

A problem associated with conventional curtain coater application heads, whether their curtain is formed by forcing coating material through an orifice, or over a weir, is that they contain pools that permit solids to precipitate from many coating materials used in coating objects. The relatively large volume of coating material that is required to fill a conventional curtain coater reservoir, pumping unit, and coating head, must be re-circulated many times as it is slowly used. Multiple re-circulation of a large volume of coating material causes degradation of the material. The two exposed surfaces of the curtain, and force circulation of air that safety precautions require for solvent vapor removal, necessitates on-line mixing to maintain proper solid content for process control. However, accurate monitoring of viscosity is complicated by evaporation cooling. Furthermore, it becomes unreliable as an indicator of solid content if viscosity changes as a result of the mechanical agitation and heat generated by re-circulation of coating material through a pump, filter, and a curtain-forming orifice. Significant, too, are evaporation rates of the constituents of a blended solvent. As evaporated solvent is replaced in response to an increase in viscosity, the system becomes progressively richer in that constituent which evaporates more slowly. Because a given volume of one constituent has a different effect on viscosity than another, viscosity again becomes a poor indicator of solid content. Moreover, as the system becomes richer in the slower evaporating solvent constituent, its drying characteristics change. Conventional curtain coaters generally are indifferent to such time-associated deterioration of coating materials.

Prior curtain coaters also failed to provide for safety of operation. The conveyors of such apparatus characteristically travel at relatively high speed and have considerable inertia, but are not provided with means for emergency stops. In this regard, the positive pumping units utilized in such prior curtain coaters were not provided with relief valves. Relief valves were omitted because of the clean-up problem involved in their use, and where hot-melt coating materials were used, the valves ceased to function when most needed, for example, when the coating materials became cold and solidified.

Another major problem associated with prior art curtain coaters is that of turbulence created at the point of entry of the coating material into the curtain coater heads, which adversely affects the uniformity of the curtain produced.

A large percentage of the operator's time is spent in cleaning a conventional coater. Rather than simplifying the clean-up process, conventional coaters have been provided with multiple coater heads, pivoting over single, or multiple troughs, or with exchangeable center sections, so that the time consuming clean-up process can take place off-line.

Moreover, when one considers that a conventional coater is cleaned by filling it with solvent and re-circulating, then draining, refilling, and re-circulating until it is washed clean, the magnitude of the fire hazard, the air pollution, and the health hazard to the operator can be readily appreciated.

Example of prior art devices are revealed in U.S. Pat. Nos. 2,935,424; 2,963,002; 2,976,837; 3,067,060; 3,088,633; 3,132,968; 3,205,089; 3,299,195 and 3,468,099.

SUMMARY OF THE INVENTION

Apparatus for coating objects with material which involves maintaining the head of a curtain coater full of the material, discharging the material through an elongated adjustable orifice at a rate to form an unbroken curtain, and conveying the objects through the curtain at a velocity to deposit a layer of the material of predetermined thickness.

Accordingly, one object of the invention is the provision of curtain coater apparatus which is safe to operate, has on-off capability of one portion relative to another, and can be quickly stopped.

One other object is to provide curtain coater apparatus wherein the coating head can be hydraulically supported, and its height readily adjusted.

Another object is the provision of curtain coater apparatus which eliminates movable knives retained by spring loaded cap screws, wherein a balance must be found between sufficiently heavy loading to prevent leaks, and sufficiently light loading to permit sliding of the movable knife over a gasket on the surface to which it attaches.

Another object is the provision of a curtain coater apparatus utilizing orifice-forming, relatively movable knives, which readily permits alignment of the movable knife relative to the fixed knife so that the curtain-forming orifice defined by the knives is of uniform width.

Another object is the provision of a curtain coater apparatus that readily permits exact duplication of orifice adjustment, and that readily permits opening of the orifice for cleaning and returning to its prior setting.

Another object is the provision of a curtain coater apparatus with pressure relief apparatus in the coating material circulation system to prevent damage to a pressure head, pump, or connecting lines.

Another object is the provision of a curtain coater apparatus having pressure relief apparatus in the coating material circulation system which is so located that it is not exposed directly to the coating material, and therefore does not require clean-up.

One other object is the provision of a coating head which is readily accessible for cleaning, and wherein turbulence at the point of entry of coating material is reduced to provide a uniform curtain of the material.

Still another object of the present invention is the provision of curtain coater apparatus with a head capable of producing a curtain of material which minimizes the entrapment of air.

Another object is the provision of curtain coater apparatus which eliminates the need for material viscosity monitoring, and solvent make-up equipment.

One other object is the provision of curtain coater apparatus which can be intermittently operated.

Still other objects, advantages, and features of the present invention will become more fully apparent as the description proceeds.

DESCRIPTION OF THE PREFERRED EMBODIMENT

Figure 1:
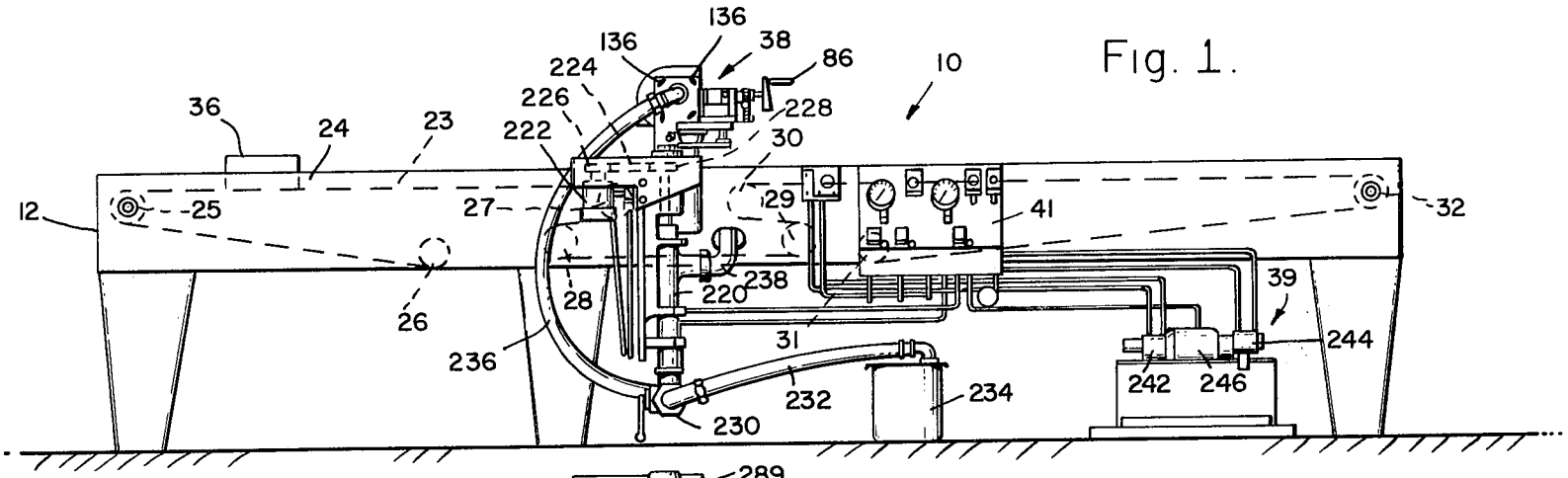
FIG. 1 is a side elevation view of the curtain coater apparatus of the present invention.
Figure 2:
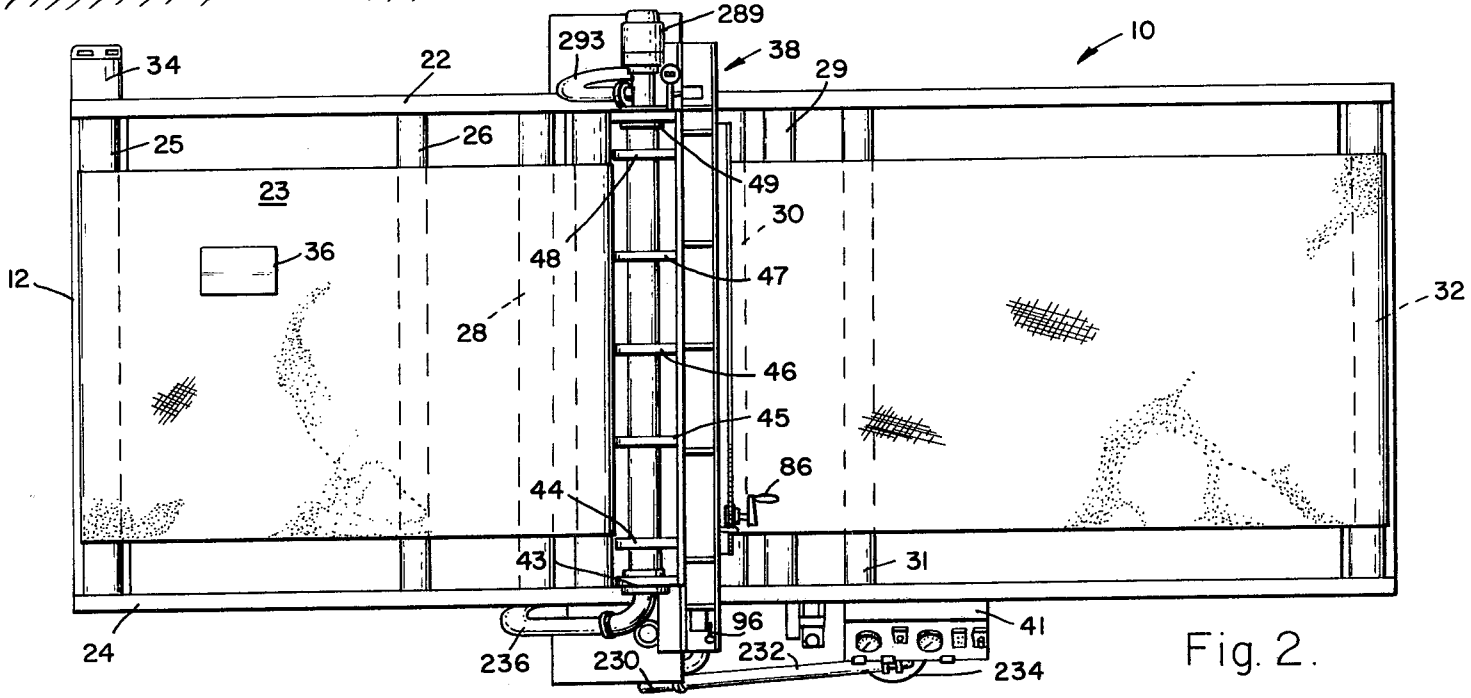
FIG. 2 is a plan view of the curtain coater apparatus of FIG. 1.
Figure 3:
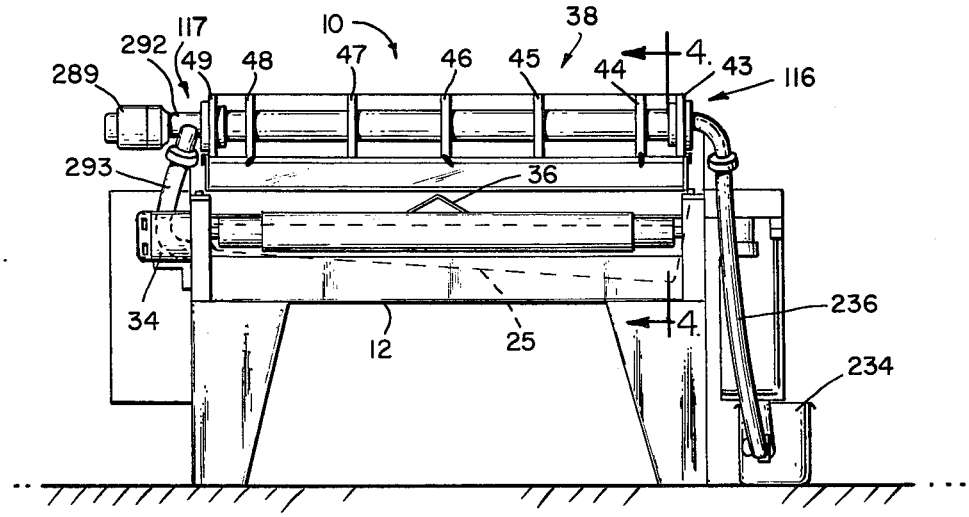
FIG. 3 is an end view of the curtain coater of FIG. 1.
Figure 4:
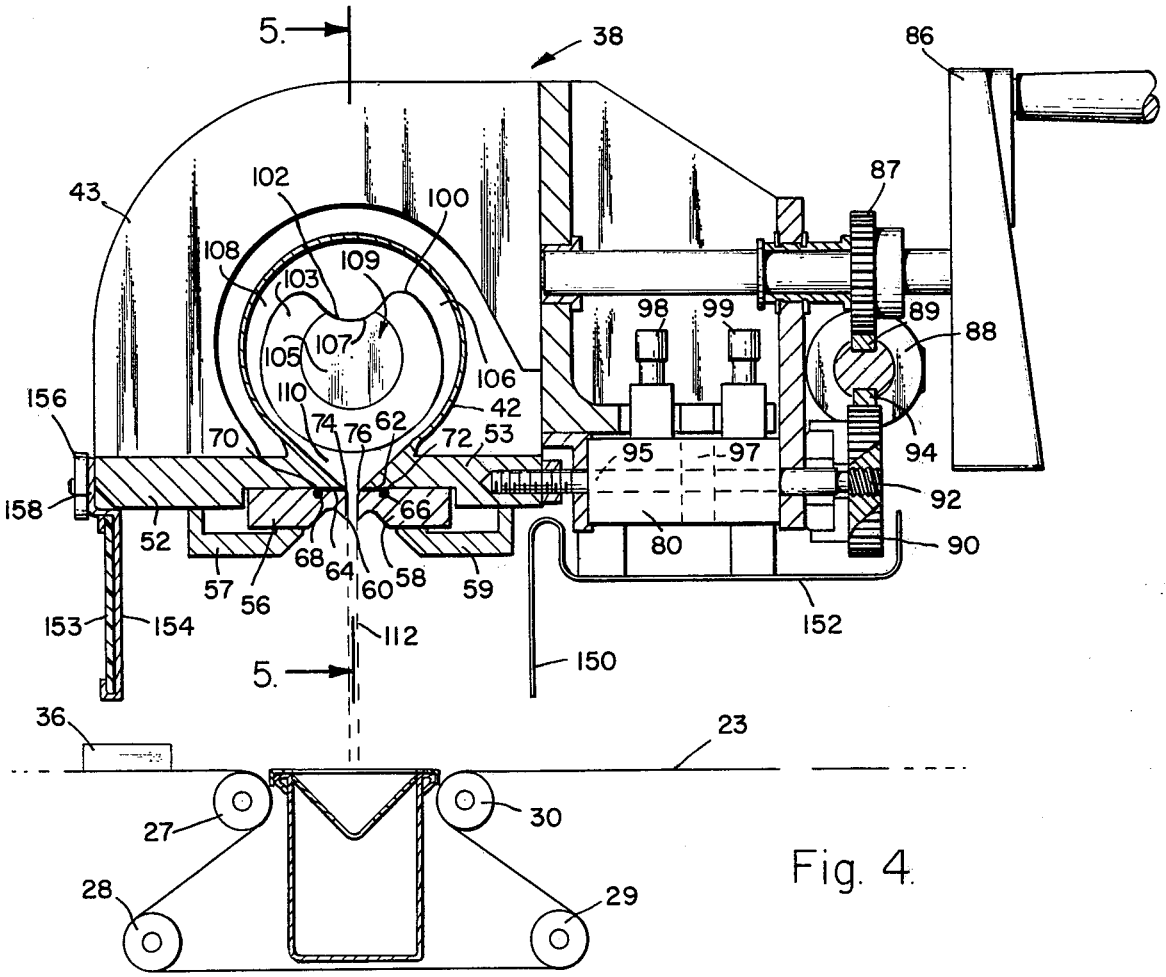
FIG. 4 is a cross-section view taken along the lines 4—4 of FIG. 3.

Referring to FIGS. 1-3, curtain coater apparatus 10 of the present invention generally comprises a conveyor 12 having a pair of side frames 22 and 24. A belt 23 is positioned around a plurality of rollers 25-32, mounted for rotation between conveyor frames 22 and 24. A fluid motor 34 is secured to frame 22, and drives roller 25, to move belt 23 for conveying an object 36 thereon, under a head 38, for coating with material flowing from the head. A power unit 39, for supplying fluid under pressure, is positioned in the vicinity of conveyor 12. A control console 41 for controlling operation of the curtain coater apparatus 10 is provided on frame 24.

Head 38, best shown in FIGS. 4-6, 7A and 7B, comprises a longitudinally split, resilient, metallic tube 42, positioned within head supporting brackets 43-49, and to which orifice knife carrying members 52 and 53 are attached.

Outboard member 52 carries a fixed orifice knife 56, secured thereto by a clamp 57, fastened as by cap screws (not shown). Inboard member 53 carries a movable orifice knife 58, also suitably secured by a clamp 59. Fixed and movable orifice knives 56 and 58 define an orifice, or slot 60, positioned over, and across belt 23, grooves are machined into the knives to prevent coating material from accumulating on their orifice edges. Flat gaskets 62 and 64 of Teflon or the like, having enlarged edges 66 and 68, respectively, are positioned in grooves 70 and 72, to provide sealing between members 52 and 53, and respective knives 56 and 58. Restraint of seal edges 74 and 76 is also provided, so that flow of coating material above the curtain coating orifice 60 is not obstructed.

The position of movable knife 58, which is controlled by a plurality of similar, adjustable stroke, hydraulic actuators 80-84, mounted on head 38, determines the width of orifice opening 60. Positioning of knife 58 is accomplished by turning hand crank 86, and gear 87 thereon, to cause control shaft 88 with upper rack 89 to translate. Translation of a lower mounted rack 94 through a distance equal to its pitch, or tooth spacing, for example, causes gears 90, which are threadedly secured on rear piston rods 92 of actuators 80-84, to move along the axes of those rods, and thereby change the length of each of their strokes by an exemplary distance of 0.001 inches. Because inner rods 95 are threaded into member 53, which carries movable knife 58, the width of orifice 60 is similarly changed.

After a desired setting is made, orifice 60 may be fully opened, and then returned to that setting by actuating hydraulic control valve 96, which is adapted to be connected to a source of fluid pressure, to be hereinafter more fully described, to apply fluid pressure simultaneously to one face of actuator pistons 97, and then to the other, by means of fluid conduit lines 98 and 99. In this manner, orifice 60 can be fully opened to clear obstructions, when desired.

The strokes of actuators 80-84 are accommodated by the transverse sliding of the teeth of gears 90 across the teeth of lower rack 94.

Normally, once positioned, knives 56 and 58 need not be disturbed. However, if it becomes necessary to remove knives 56 and 58, they can be exactly repositioned by first aligning their ends, and those of clamps 57 and 59, with the ends of members 52 and 53. The securing cap screws (not shown) of clamps 57 and 59 are finger-tightened. Gears 90 are then turned so that they will not abut the frame of head 38 when knives 56 and 58 are closed. Control valve 96 is now actuated to close knives 56 and 58, and while thus held firmly together by actuators 80-84, the clamp cap screws (not shown) are tightened. Gear 87 on hand crank 86 is then disengaged, and gears 90 are turned until they abut the frame of head 38. Shaft 88 is positioned with its end abutting stop-screw 91, and gears 90 are simultaneously engaged by bottom rack 94. With gear 87 still disengaged, hand crank 86 is rotated until the "0" mils mark 93 on a scale (not shown), on the hub of gear 87, aligns with index mark 95 on head 38. Gear 87 is then engaged, and secured with thumb screw 101.

Knives 56 and 58 are now held at zero orifice width by actuators 80-84. Gears 90 on actuators 80-84 are set at zero clearance from head 38. Control shaft 88 has zero clearance with stop-screw 91, and zero indexing is obtained. Thus, as hand crank 86 is turned, movement equal to one tooth causes gears 90 on actuators 80-84 to reduce their strokes by an exemplary one mil. The reading on the scale (not shown), on the hub of gear 87, at index mark 95, indicates the total reduction in length of stroke, which equals the width, in mils, of orifice 60. Thus, actuators 80-84 hold moveable knife 58 in precise alignment with, and at a precise distance from, fixed knife 56.

Turbulence at the point of entry of coating material into a conventional curtain coater head adversely affects the uniformity of the curtain formed. In head 38 of the present invention there is provided a filler tube 100 having an upper quadrant outer surface 102 forming a trough for evenly distributing coating material throughout the length of head 38. One end of tube 100 is provided with an inwardly tapered surface portion 103, terminating in a flat portion 105, and forming with upper quadrant inner surface 107, an end cavity 109. Surfaces 102 and 107 form a lip 111, at the one end of tube 100. The other end of tube 100 is similar, but has no lip corresponding to lip 111.

Passageways 106 and 108, provided within head 38, between filler tube 100 and tube 42, conduct the coating material at a relatively high velocity, from trough 102, into chamber 110, above the orifice forming knives 56 and 58. By the time the coating material is forced through orifice 60, irregularities in its flow will have dissipated, and curtain 112 will be uniform across the width of orifice 60. Guide members 113 are positioned and movably attached adjacent the opposite ends of orifice 60 (see FIG. 8A) and function to provide guide members along which the lateral edges of curtain 112 can travel and to move free of part 36 on contact. The upper ends of guide members 113 pass through apertures 159 (see FIG. 8A) with their heads 114 being biased outwardly by springs 115. The guide members 113 may be readily removed for cleaning by manually compressing the springs 115. The relatively high velocity of the small volume of coating material that is within head 38 at a given time minimizes the opportunity for solids to precipitate. Passageways 106 and 108 are so shaped that there are no ledges, or crevices to promote accumulation of solids. The flattest surfaces within resilient tube 42 have approximately 45° slopes which are constantly washed by the coating material.

Figure 5:
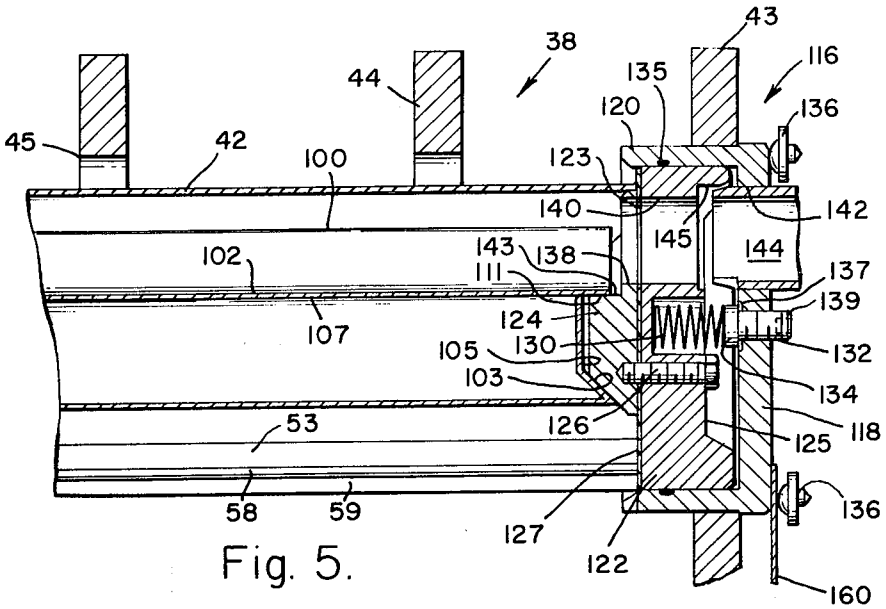
FIG. 5 is a cross-section view taken along the lines 5—5 of FIG. 4 showing details of one end assembly.
Figure 5A:
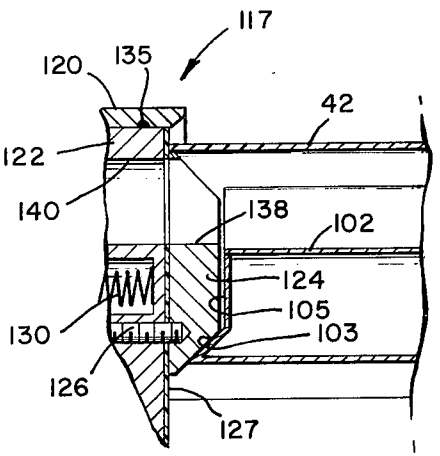
FIG. 5A is a fragmentary portion of a cross-section view similar to FIG. 5 showing details of the other end assembly.
Figure 6:
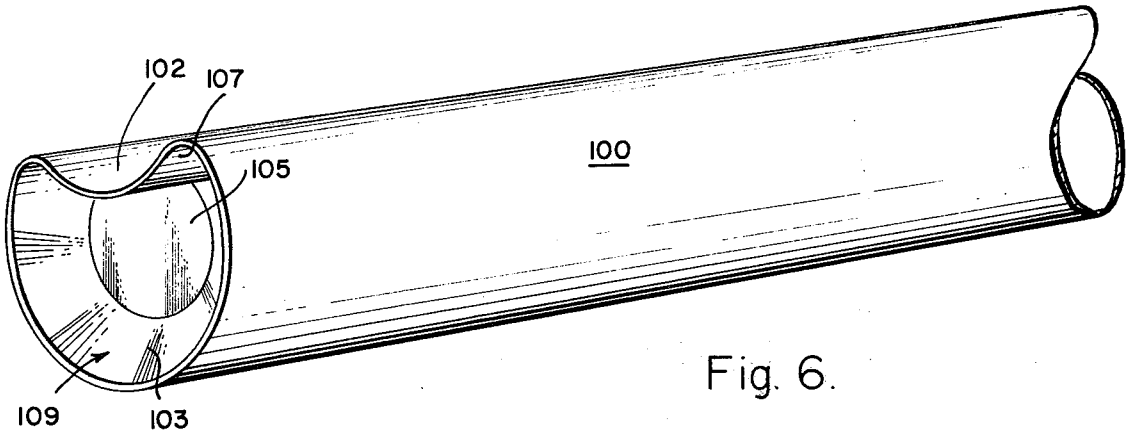
FIG. 6 is a perspective showing of the filler tube utilized in the present invention.
Figure 7A:
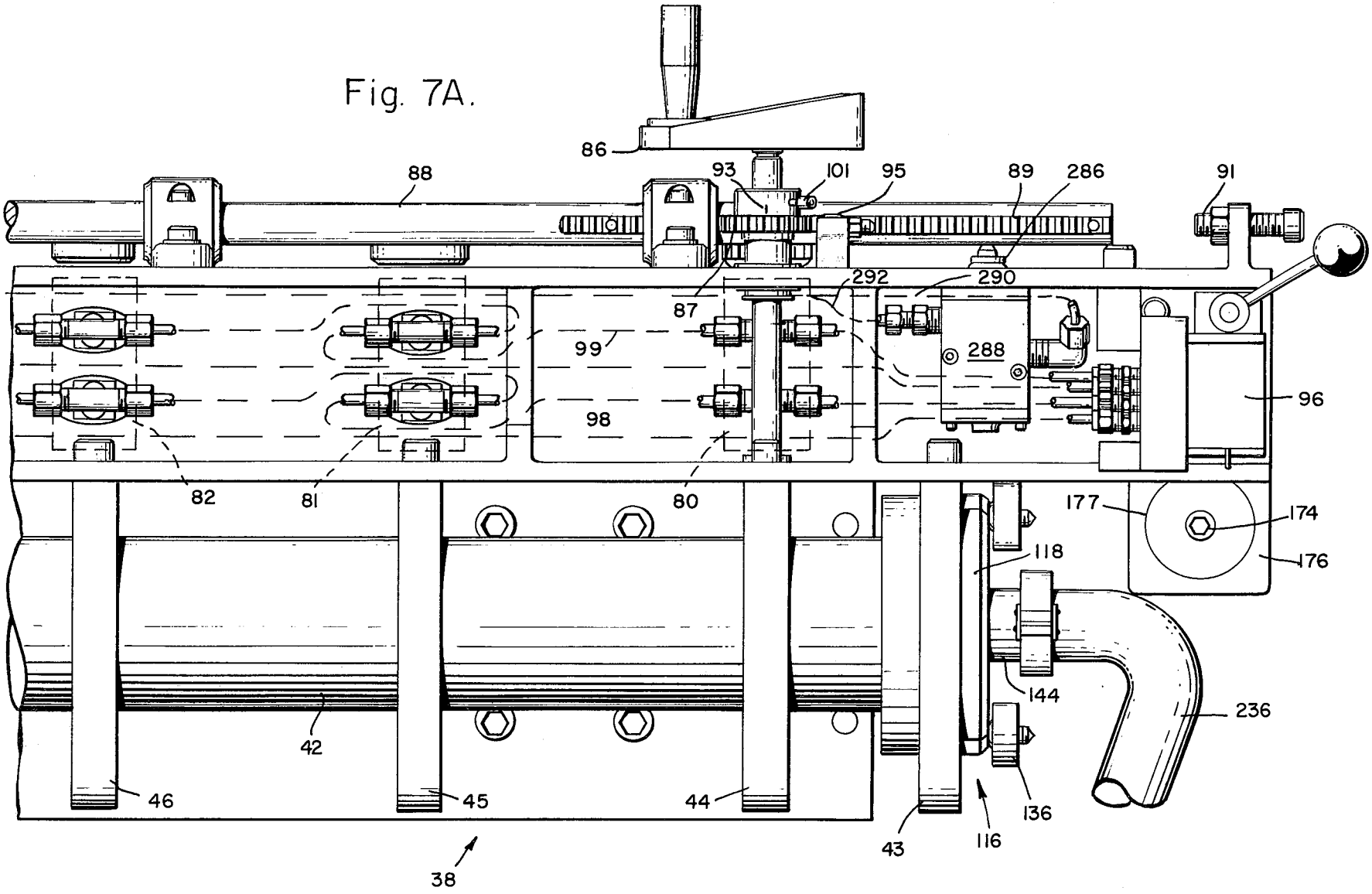
FIGS. 7A and 7B are an enlarged top view showing details of the head of the curtain coater of the present invention.
Figure 7B:
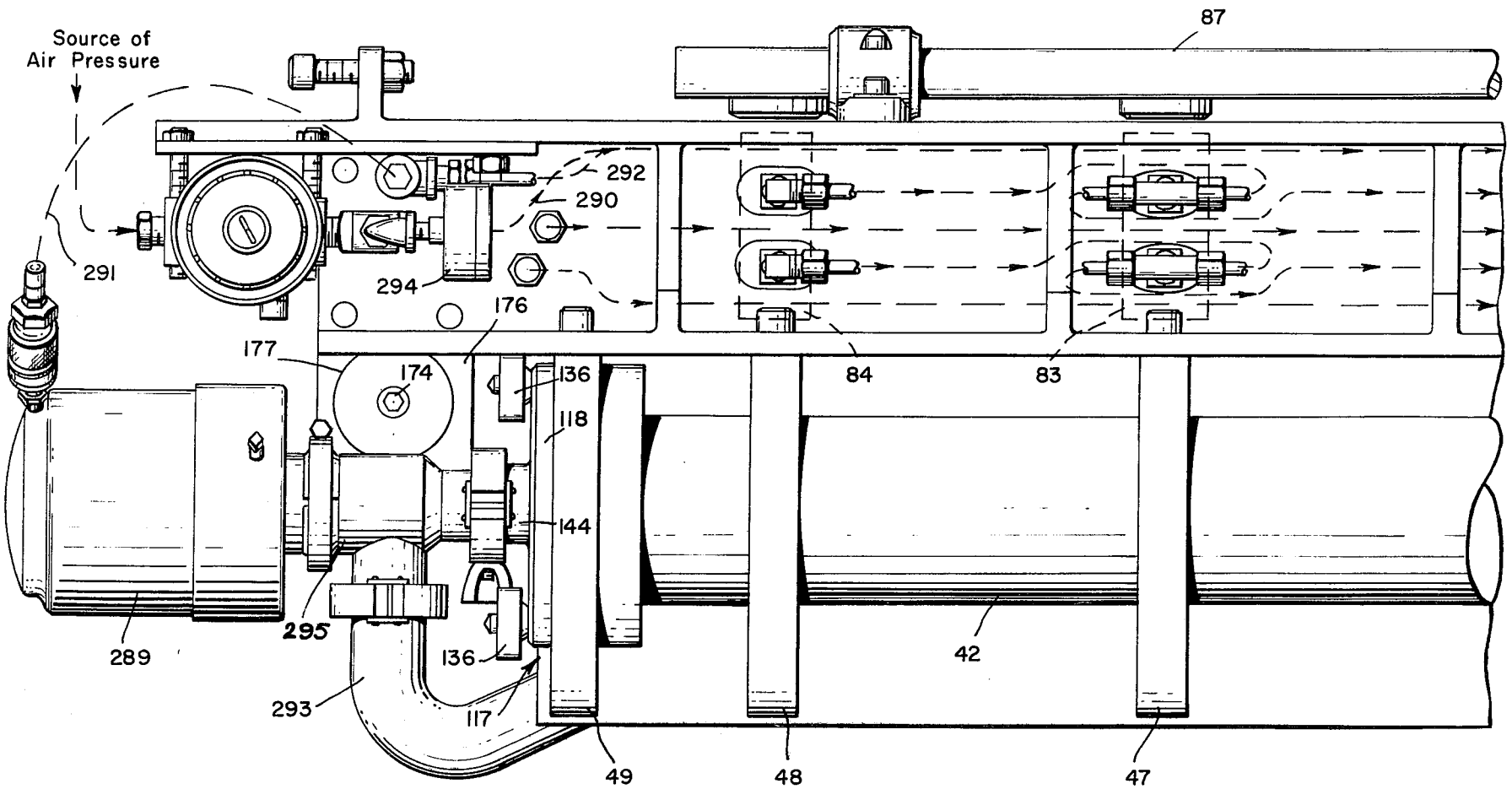

The ends of tube 42 are closed by removable assemblies 116 and 117, best shown in FIGS. 5 and 5A, which provide sealing that accommodates to the varying shape of tube 42, as the settings of orifice 60 change. Assembly 116 consists of an end flange 118 having a cylindrical portion 120 carrying a piston 122. A tapered member 124 is positioned on one face 123 of piston 122, and secured thereto, as by screws 126. A flat Teflon, or like material, gasket 127 is positioned intermediate face 123, and tapered member 124. Piston 122 is spring biased toward resilient tube 42, as by an arrangement of a spring 130 and bolt 132, threadedly engaged in flange 118. A flat Teflon washer 137 is retained between bolt head 134 and end flange 118 to seal the threads. Flange 118 is connected to bracket 43 by a plurality of nut and stud arrangements 136. Gasket 127, on face 123 of piston 122, abuts the end of tube 42 to effect sealing therebetween due in part to the urging of spring 130. As tapered member 124 is received in cavity 109, in the one end of filler tube 100, the tapered member and the tube become substantially concentric, thus defining passgeways 106 and 108. A passageway for the flow of coating material to trough 102 is formed by substantially coaxial openings 138, 140, and 142, through tapered member 124, piston 122, and flange 118, respectively. The lip 111, formed by surface 102 and 107, at the one end of filler tube 100, enters a cavity 143 in tapered member 124 to restrain the filler tube from rotating about its axis and thereby to maintain trough 102 alignment with openings 138 and 140. Pipe 144 supplying coating material is fastened, as by welding around opening 142, in flange 118. Pipe 144 enters the enlarged portion 145 of opening 140 in piston 122 so as to prevent the rotation of the piston relative to cylinder 120. Consequently, trough 102 is maintained in substantial coaxial alignment with openings 138, 140, and 142.

Although the hydraulic pressure of the coating material is substantially equal on both faces 123 and 125 of piston 122, the effective area of face 125 is greater, which results in a differential force urging piston 122 toward flexible tube 42, further to effect sealing. Spring 130 need urge piston 122 and its associated parts against the end of tube 42 with no greater force than that required to establish sealing. As the pressure to be contained in tube 42 increases, the force resulting from the hydraulic imbalance increases to provide the necessary sealing.

An O-ring gasket 135 is carried in a groove in cylinder 120 to effect sealing between piston 122 and the cylinder, so as to prevent leakage of coating material from the cylinder. Screw 132 is provided with a hexagon-shaped socket 139 in its exposed end to receive an Allen wrench, for rotation, by means of which it is moved inward, to push piston 122 out of cylinder 120, so that all surfaces exposed to coating material are readily accessible for thorough cleaning.

Removal of end seal assemblies 116 and 117 makes accessible the interior of tubular member 42 for cleaning.

Assembly 117 is similar to assembly 116, and like numerals designate like parts, as illustrated in FIG. 5A. Since the other end of tube 100 does not have a lip corresponding to the lip 111, tapered member 124 of assembly 117 is not provided with a cavity similar to the cavity 143 of tapcred member 124 in assembly 116.

Windscreens are provided to surround the curtain 112, below the curtain-forming orifice 60. A portion 150 of a drip pan 152 serves as an infeed screen. Drip pan 152 is positioned beneath hydraulic knife actuating cylinders 80–84.

In the event of a leak in cylinders 80–84, oil is caught and drained to the side of the curtain coater apparatus 10. Outfeed screen 153 is a replaceable, transparent, plastic window, carried in a suitable holder 154, attached to member 52, as by nut and stud arrangements 156, and the bar 158. End screens 160 are secured to flange 118 by nut and stud arrangement 136.

Figure 8:
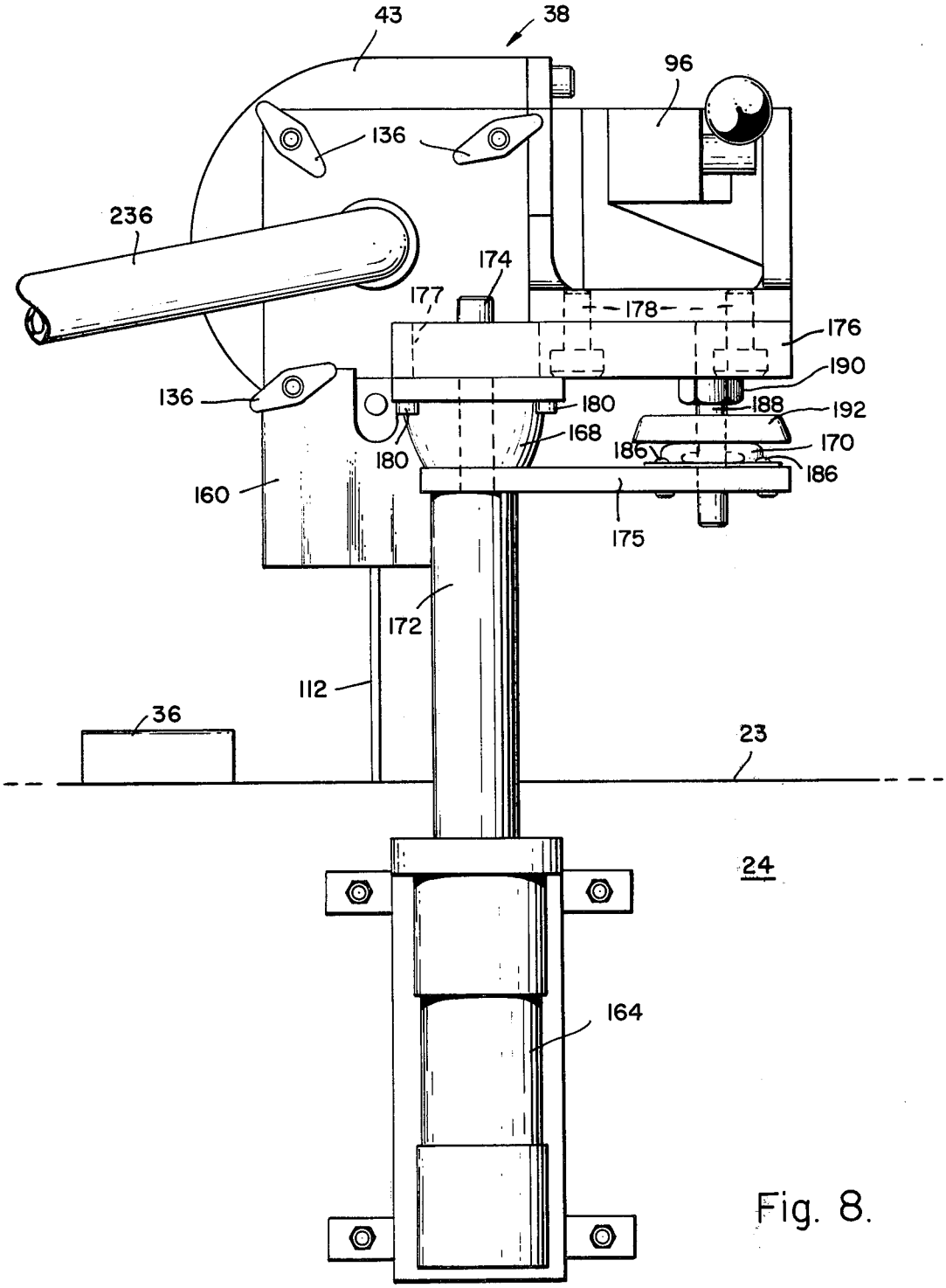
FIG. 8 is an enlarged end view of the head and supporting actuator of the curtain coater.
Figure 8A:
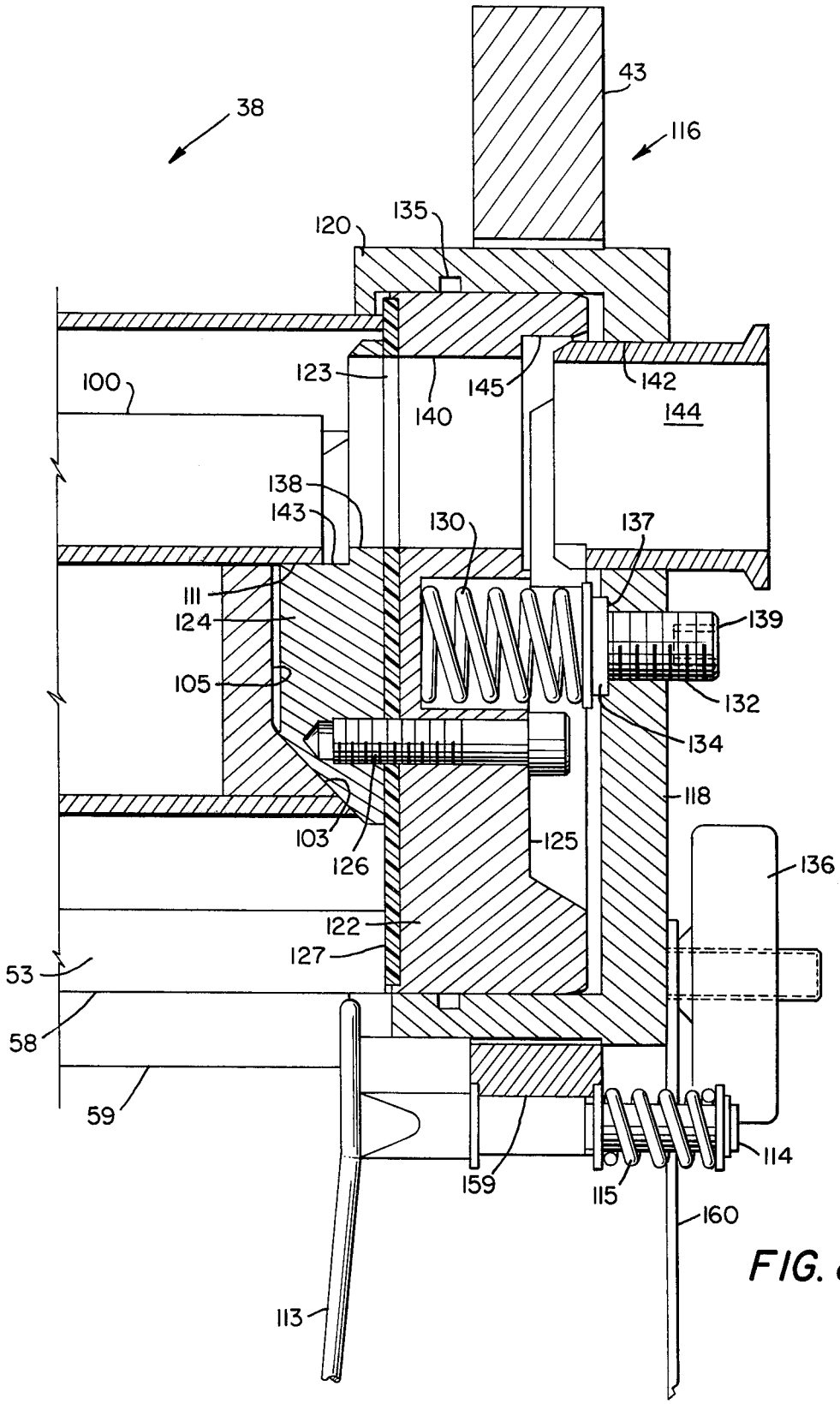
FIG. 8A is a perspective view of the end of the head illustrating the guide wire that forms the lateral boundary of the curtain.

Referring to FIG. 8, the height and lateral levelness of coating head 38 is readily adjustable by a pair of similar, supporting, equalized hydraulic actuators 164, mounted on frames 22 and 24, and vibration-absorbing mounts 168, and 170. Each actuator 164 has a piston rod 172, with a tapped hole, to receive a cap screw 174, passing through an orifice 177 in a plate 176, resilient mounting member 168, and a plate 175. Plate 176 is mounted on head 38, as by recessed cap screws 178. Vibration-absorbing mounting member 168 is fashioned from Neoprene, or the like, and is fastened to plate 176 by screws 180. Member 170 is attached to the top surface of plate 175 by bolt and nut arrangements 186, and is fashioned from material similar to member 168. A stud 188 is locked by means by jam nut 190 into plate 176. stud 188 projects downward from plate 176 through a clearance bushing in member 170. A wing nut 192, threadedly engaged with stud 188, bears against the top surface of the bushing, and can be rotated in one direction, against member 170, to urge stud 188 and the end of plate 176 in an upward direction.

Rotation of nut 192 in the opposite direction, away from mount 170, serves to urge the bolt away from plate 176, resulting in a lowering of the plate end. Manipulation of nuts 192, as hereinbefore set forth, can be utilized to provide lateral leveling of head 38, as desired.

Figure 9:
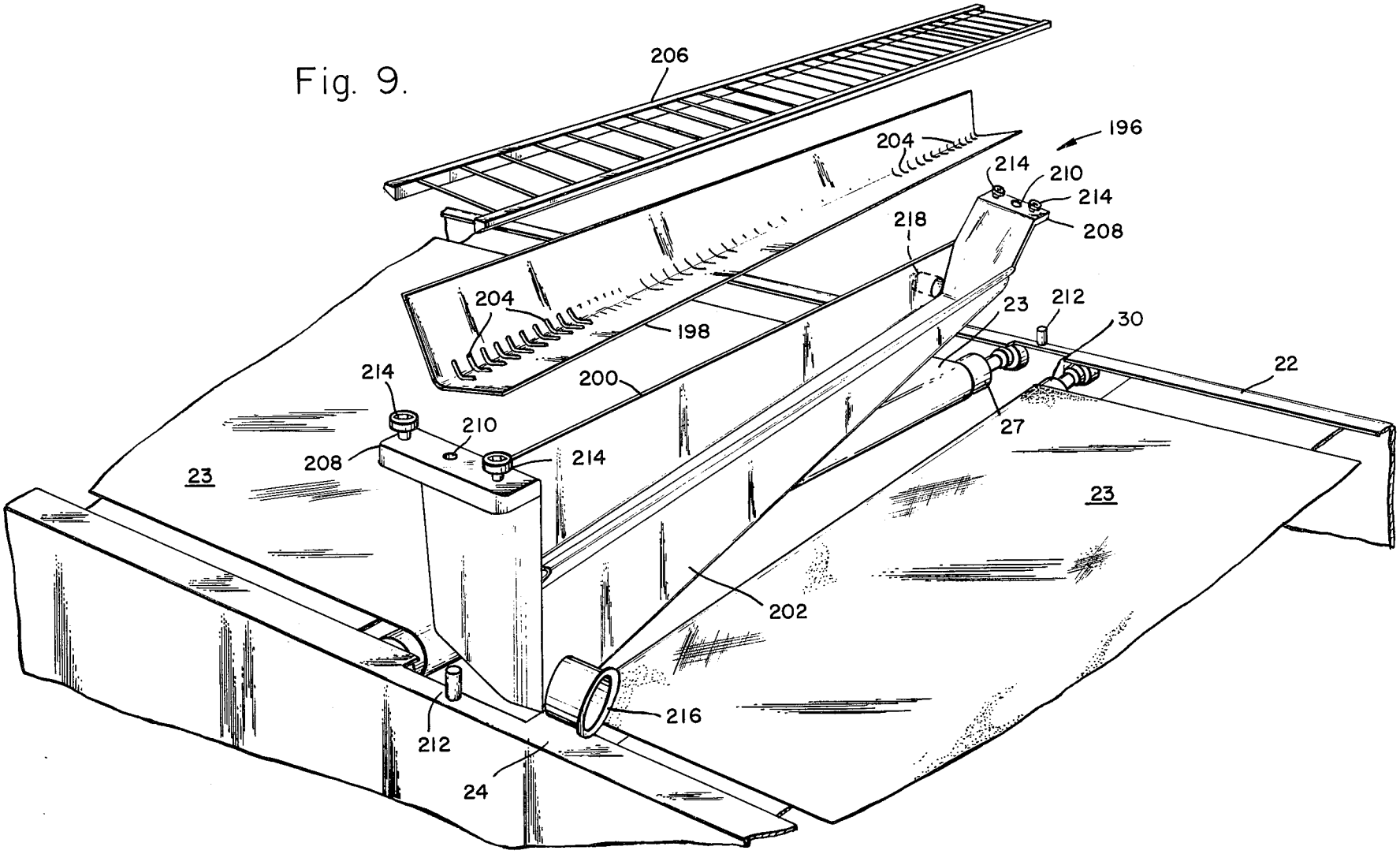
FIG. 9 is an exploded perspective view of the receptacle apparatus utilized in the present invention.

A receptacle 196, best shown in FIG. 9, receives that portion of the curtain 112 not intercepted by object 36. A baffle plate 198, which prevents splashing of coating material, covers the upper portion of a trough 200 of receptacle 196. A cavity with a sloped bottom, below plate 198, serves as a reservoir 202. Flow of coating material through trough 200, which is flat sided, and relatively narrow, into reservoir 202, provides sufficient agitation of the material to prevent the settling of solids. The relatively small surface area of the coating material reduces evaporation of the material solvent. Plate 198 is perforated at 204, in the area where the curtain 112 impinges, to permit the coating material to flow into reservoir 202, and to prevent objects from falling into the reservoir. A wire grid 206, positioned over trough 200, and reservoir 202, facilitates the passage of small objects to be coated over the coating area. Flanges 208, having holes 210, which accommodate studs 212 on the frames 22 and 24, serve to position receptacle 196 on conveyor 12, between pulleys 27 and 30. Bolts 214 are threaded through flanges 208, and bear against frames 22, and 24, and serve to level receptacle 196. Receptacle 196 is additionally provided with coating material inlet 218 and outlet 216.

Reference is again made to FIG. 1. Provided on frame 24 are fluid pump 220, and fluid motor actuator 222, for rotating the pump through belt 224, and pulleys 226, and 228. One end of pump 220 is connected, by means of a threeway valve 230, through a conduit 232, to a source of coating material 234, and through a conduit 236 to head 38. The other end of pump 220 is connected, through conduit 238, to fitting 216 of receptacle 196, FIG. 9. Pump 220 is preferably of the helical screw type, which can pump coating material equally well in either direction, depending on the direction of rotation of motor 222.

Figure 10:
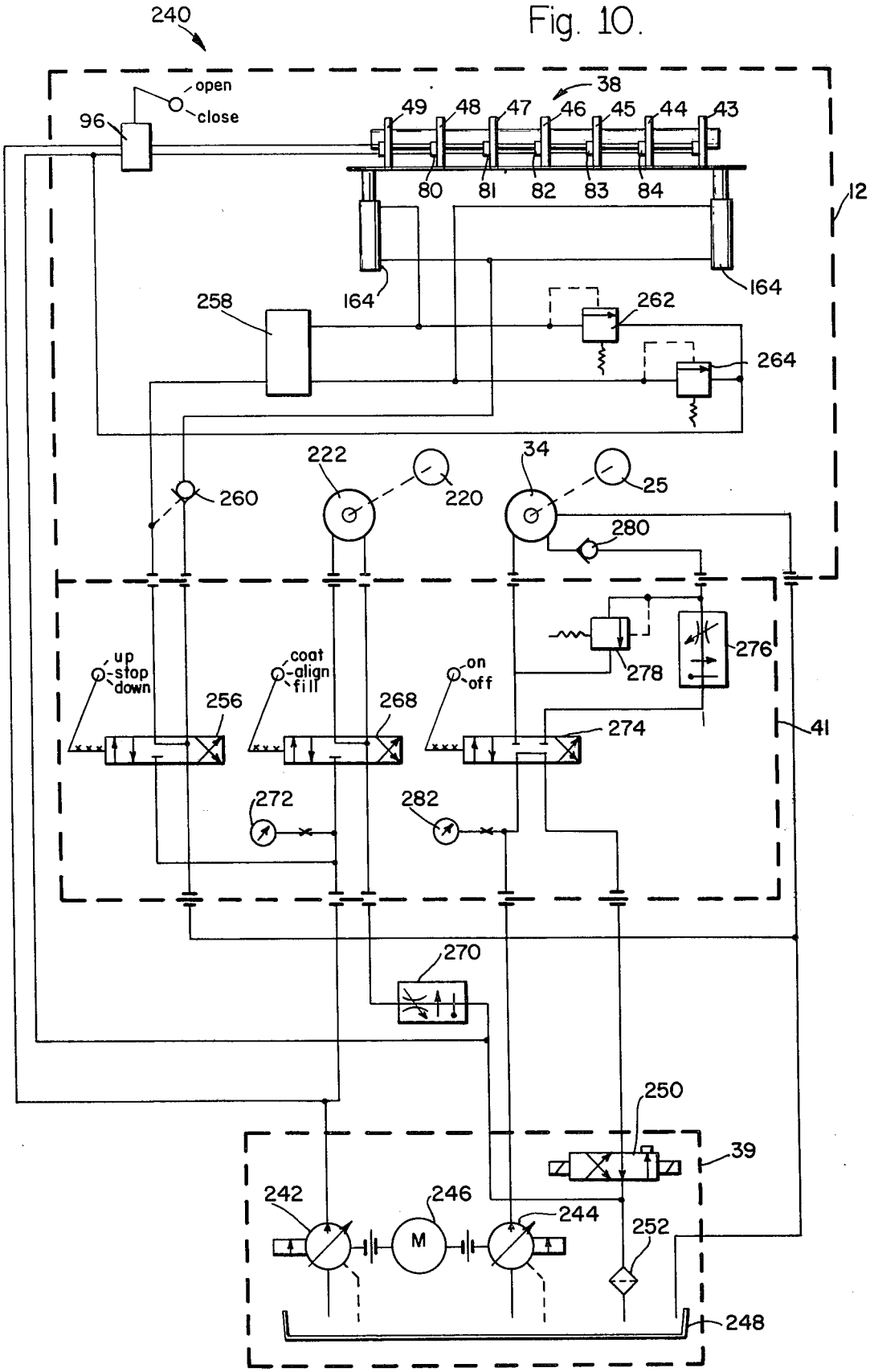
FIG. 10 is a detailed illustration of the control apparatus of the present invention.

Reference is now made to FIG. 10 wherein the hydraulic fluid system 240 of the present invention is shown in detail. Power unit 39 consists of a pair of fluid pumps 242, and 244, driven by an electric motor 246, a source of fluid 248, such as oil, an emergency stop valve 250, and a fluid filter 252.

A fluid circuit is provided wherein pump 242 is suitably connected, through orifice control valve 96, to knife actuators 80–84. Also, fluid circuit connection is made through a spring-centered head control valve 256, to head support actuators 164, to provide fluid for raising, holding, lowering, and leveling of head 38. A flow divider 258 is provided in the circuit, which directs essentially one-half of the total fluid flow to each of the two actuators 164. A pilot-operated check valve 260 is included, which serves to maintain head 38 at an intermediate level, while two relief valves 262 and 264 provide for the longitudinal leveling of head 38.

Another circuit is suitable connected to utilize fluid from pump 242 to drive motor 222, which actuates pump 220. A pump control valve 268 and speed control 270 are provided for controlling motor 222. A gauge 272 for measuring fluid line pressure is included in the fluid circuit.

Pump 244, suitably connected, supplies fluid pressure to belt drive motor 34, through belt control valve 274. Provided in the belt drive fluid circuit is a belt speed controller 276, a relief valve 278, a check valve 280, and an emergency stop valve 250. A gauge 282 measures the line pressure in the belt drive circuit. Relief valve 278 cushions the circuit when emergency stop valve 250 is operated.

Both controllers 270 and 276 are throttle valves, which provide a predetermined fluid flow rate regardless of changes in pressure or temperature.

Pumps 242 and 244 are pressure-compensated and deliver that volume of oil that valves 270 and 276, respectively, are adjusted to pass while maintaining predetermined pressures. If either of the valves 270 or 276 is closed, its respective pump will relieve internally.

Referring again to FIGS. 7A and 7B, there is shown a three-way valve 288 carried by head 38, which, when operated by valve controller 286, serves to apply air pressure from a source (not shown) to a valve actuator 289 through lines 290, 291, and 292. A gauge 294 is utilized for measuring line pressure in the actuator circuit. Normally, valve control 286 is outwardly spring biased, and rides in a groove (not shown), provided on control shaft 88. As long as shaft 88 occupies a position, as shown, which corresponds to an opened orifice 60, valve 288 remains open, and air pressure is applied to actuator 289 to close the valve 295, which interconnects inlet 144 of assembly 117, and conduit 293. However, when shaft 88 is positioned with its end abutting screw 91, providing zero width to orifice 60, controller 286 is urged out of the groove (not shown), and opens valve 288 to exhaust air pressure from actuator 289. Actuator 289 now opens valve 295, which remains open as long as shaft 88 abuts screw 91.

A substantially linear relationship exists between the speed of pump 220 pumping coating material, the speed of belt 23 conveying the article 36 to be coated, and the thickness of the coating of material applied to the article. Generally, doubling pump speed requires the doubling of belt speed to maintain a pre-determined coating thickness.

Figure 11:
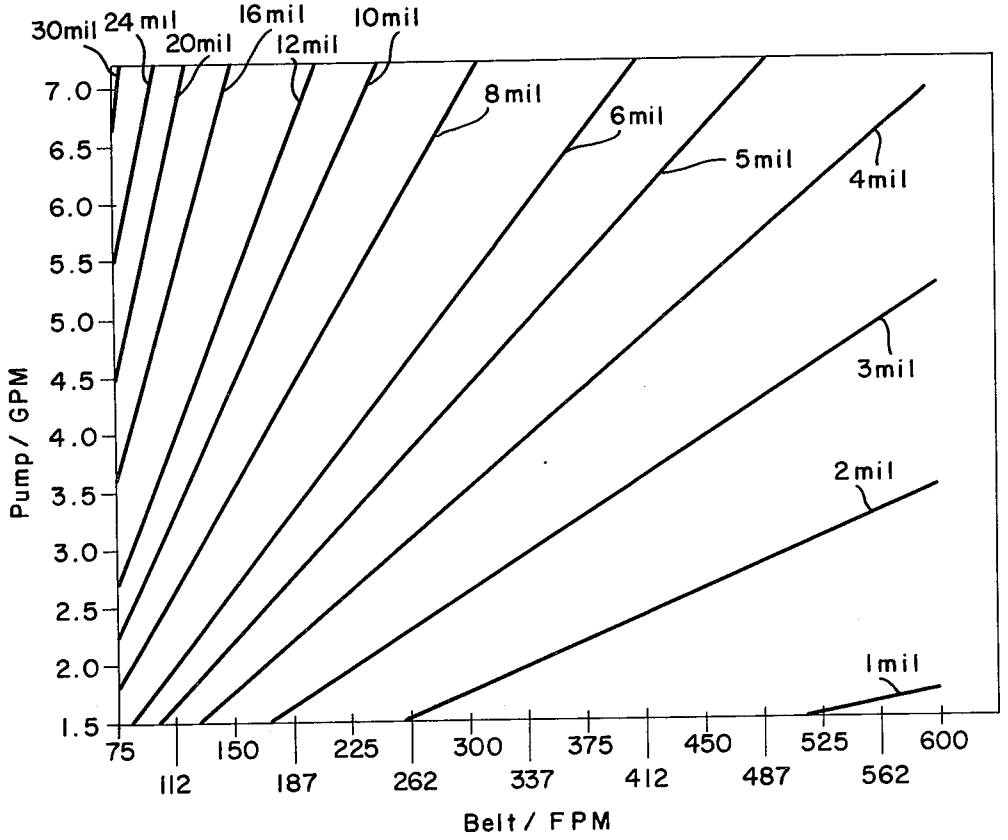
FIG. 11 is a graph helpful in understanding operation of the curtain coater apparatus of the present invention.

From a curtain coater, constructed in accordance with the present invention, wherein the curtain 112 width was 53.8 inches, drive pulley 25 for belt 23 had a 6 inch diameter, and pump 220 was capable of pumping 2.02 gallons of coating material for every 100 revolutions, the graph of FIG. 11 was derived, relating coating thickness T, in mils, to the belt speed ($RPM_B$), in revolutions per minute, and the pump speed ($RPM_p$), in revolutions per minute.

Operation of curtain coater 10 can best be understood by having reference mainly to FIG. 10. Initially, to prepare the coater 10 for coating an object, orifice adjust control handle 86 is rotated to position mark 93 opposite index 95, which corresponds to a zero opening of orifice 60. Orifice control valve 96 is set to the "CLOSE" position. Belt control valve 274 is set to "OFF." Pump control valve 268 is set to "ALIGN," the position which provides no fluid flow to pump actuator motor 222, and accordingly, no rotation of pump 220 in either direction. Pump speed valve 270 is set to an arbitrary position, for example, one that would provide approximately 250 RPM to pump 220, when motor 222 is actuated.

Next, the control lever of coating valve 230 is set to open conduit 232 to pump 220, and the start switch (not shown) is operated to start motor 246, which actuates pumps 242 and 244 of power unit 39.

At this point, to avoid spilling coating material onto belt 23, and automatically to level head 38, head control valve 256 is held in the "Down" position, which supplies fluid under pressure from pump 242 to cylinders 164, in such a direction to effect lowering of head 38. After head 38 has bottomed, valve 256 is held in the "DOWN" position for a few seconds, to allow relief valves 262 and 264 to effect the automatic leveling.

Pump 220 is now primed by pouring approximately one quart, for example, of the coating material into reservoir 202. Pump control valve 268 is then moved to the "FILL" position, which supplies fluid under pressure, from pump 242, in such a direction, as to rotate fluid motor 222 to actuate pump 220 to draw coating material from source 234, through conduit 232, valve 230, pump 220, conduit 238, and into reservoir 202. When the coating material in reservoir 202 reaches a level which covers slots 204 of baffle plate 198, pump control valve 268 is then moved to the "ALIGN" position, which stops supply of fluid pressure to motor 222, and consequently stops pump 220.

Three-way coating valve 230 is now positioned to open conduit 236 to head 38, and pump control valve 268 is moved to the "COAT" position. Motor 222 rotates in the opposite direction, and pump 220 drives the coating material from reservoir 202, through conduit 236, to head 38. As head 38 fills with material, air is discharged through valve 295, conduit 293, and into reservoir 202.

When head 38 has completely filled with coating material, pump control valve 268 is moved to the "ALIGN" position, three-way valve 230 is positioned to open conduit 232, and pump control valve 268 is moved to "FILL." Coater material again flows from container 234, through conduit 232, valve 230, pump 220, and into reservoir 202. When the material again rises to cover slots 204, coater 10 is fully filled.

Pump control valve 268 is next moved to "ALIGN," three-way valve 230 is moved to connect pump 220, through conduit 236, to head 38, and valve 268 is then moved to the "COAT" position. Material now circulates from pump 220, through head 38, by-pass valve 295, line 293, into reservoir 202, and returns through line 238 to pump 220.

Next, orifice adjust handle 86 is moved to open orifice 60 and to close bypass valve 295, and pump speed controller 270 is adjusted to provide pump 220 the minimum speed sufficient to form a stable curtain of the material passing through orifice 60. Because coating material pump 220 is of the positive displacement type, and all the material that is pumped to head 38 must come out through orifice 60, adjustment of the width of orifice 60 has virtually no effect upon the quantity of coating material applied to object 36. With a given speed of pump 220, adjustment of the width of orifice 60 primarily controls the initial downward velocity imparted to curtain 112 to accommodate a particular coating material and object. The relationship between the speed of pump 220, and the width of orifice 60, determines the stability of the curtain. The relationship between the speed of pump 220, and the speed of belt 23, determines the coating thickness.

The height of head 38 should now be adjusted by operating valve 256 so that object 36, for example, will clear windscreens 150 and 153 by a minimum of ½ inch. Generally, highly contoured objects 36 require greater clearance.

The value of the setting of pump speed regulator 270 is now determined, and read on coating thickness graph, FIG. 11, from which the corresponding setting of belt speed regulator 276 for a thickness T can be obtained. Regulator 276 is now adjusted to this setting, and belt control valve 274 is moved to the "ON" position.

At this point in operation, an object 36 is allowed to pass through curtain 112, and if the curtain breaks, the width of orifice 60 is narrowed to impart greater initial downward velocity to curtain 112 or the height of head 38 above belt 23 is increased to provide "stretch" in the curtain, to accommodate for a difference in the velocity of curtain 112, and the velocity of object 36.

The downward velocity of curtain 112, and the horizontal velocity of object 36, need not be precisely synchronized, to lay a curtain smoothly onto object 36, at a precisely controlled thickness. The magnitude of the difference that can be tolerated depends upon the elasticity of the coating material, and the shape of object 36.

If neither a narrower width of orifice 60, nor an increase in the height of head 38, eliminates breaks in curtain 112, the speed of pump 220 should be increased, with a corresponding increase in the speed of belt 23, as provided for in FIG. 11.

For optimum operation, a combination of a narrower orifice 60, an increase in the height of head 38, and increased speeds of pump 220 and belt 23 may be required in certain instances. For example, when coating viscous, stringy material, such as Neoprene adhesive, head 38 is generally raised well above belt 23, the relationship of the speed of pump 220, and the width of orifice 60, is such that a considerable initial downward velocity is imparted to curtain 112 to avoid entrapping large bubbles of air between curtain 112 and object 36.

Finally, after an unknown curtain 112 has been formed, objects 36 can be passed through the curtain on a mass production basis, with ocassional spot checks to determine the film thickness T being applied to the objects.

If a particle of foreign matter causes a break in curtain 112, the orifice control valve 96 is moved from "CLOSE" to "OPEN" to dislodge the particle. Upon returning the valve 96 to "CLOSE" position the movable knife 58 will return to its preset position to reestablish orifice 60.

The curtain coater 10 of the present invention can be placed into a stand-by mode for a limited time, which varies with different coating materials, and quantity of coating material contained in the coater, when placed on stand-by. To place the coater 10 into a stand-by mode, belt control valve 274 is moved to the "OFF" position, pump control valve 268 to "COAT," pump speed control 270 is set so that pump 220 delivers approximately three gallons of material per minute, orifice control handle 86 is set to "0" mils, and orifice control valve 96 is positioned to "CLOSE". By-pass valve 295 opens automatically, and the coating material slowly circulates through head 38, conduit 293, reservoir 202, conduit 238, pump 220, valve 230, and conduit 236, to hold particles in suspension.

While there has been illustrated a preferred embodiment of the invention, it will be readily understood that various modifications and changes may be made therein without departing from the spirit of the invention or the scope of the following claims.

Having thus described the invention, what is claimed as new and useful and desired to be secured by U.S. Letters Patent is:

1. A curtain coater for depositing material onto an object comprising:

a support;

a longitudinally split, resilient, tubular member;

a pair of knife members carried by said tubular member defining an orifice along the split, one of said knife members being attached to said support and the other knife member being movable to adjust the width of said orifice;

end closure means carried by said support and in engagement with each end of said tubular member in sealing relationship to form a chamber therein to contain coating material and to accommodate changes in the shape of said tubular member when the width of said orifice is adjusted, said end closure means each having a material passageway therethrough to said chamber, and comprising a cylinder attached to said support and having an orifice through its end, a movable piston having a tapered portion on one face in said cylinder, said piston and tapered portion having orifices coincident with said orifice in said cylinder to define said passageway, and means carried by said cylinder and piston for urging said piston to effect sealing between the piston face and an end of said tubular member around said tapered portion;

means for maintaining said chamber substantially full of the coating material to discharge through said orifice at a velocity to form a stable curtain of the material; and means for conveying said object through said curtain at a velocity to deposit a layer of the material of predetermined thickness.

2. The curtain coater set forth in claim 1, wherein the movable knife member is fixedly attached to its support structure.

3. The curtain coater set forth in claim 1, wherein fixed and movable knife members are substantially coplanar.

4. The curtain coater set forth in claim 1, wherein the external surfaces adjacent to the exit tips of the orifice-forming knife members are recessed.

5. The curtain coater set forth in claim 1, additionally comprises;

a pair of guide members for defining the edges of said curtain.

6. The curtain coater set forth in claim 5, wherein said pair of guide members is movably attached to its support structure.

7. The curtain coater of claim 5, wherein said guide members move free of said object on contact therewith.

8. The curtain coater set forth in claim 5, wherein said guide members are easily removable.

9. The curtain coater set forth in claim 1, wherein said means for urging said piston comprises:

a spring carried by said piston;

a bolt threadedly engaged in the end of said cylinder and having a head abutting said spring.

10. The curtain coater set forth in claim 1, further comprising:

distributing means for uniformly distributing coating material throughout the interior length of said tubular member and forming passages with the walls of said tubular member leading to said orifice for reducing turbulence of the coating material.

11. The curtain coater set forth in claim 1, further comprising:

distributing means for uniformly distributing coating material throughout the interior length of said tubular member and forming passages with the walls of said tubular member leading to said orifice for increasing velocity and to reduce precipitation.

12. The curtain coater set forth in claim 10, wherein said distributing means comprises:

a tube having closed ends positioned within said tubular member throughout its length and above said orifice, the upper quadrant of said tube defining a trough in communication with said passageways.

13. A curtain coater for depositing material onto an object comprising:

a support;

a longitudinally split, resilient, tubular member;

a pair of knife members carried by said tubular member defining an orifice along the split, one of said knife members being attached to said support and the other knife member being movable to adjust the width of said orifice;

end closure means carried by said support and in engagement with each end of said tubular member in sealing relationship to form a chamber therein to contain coating material and to accommodate changes in the shape of said tubular member when the width of said orifice is adjusted, said end closure means each having a material passageway therethrough to said chamber;

means for maintaining said chamber substantially full of the coating material to discharge through said orifice at a velocity to form a stable curtain of the material, said means for maintaining comprising a receptacle for containing coating material and adapted to be located below the object to be coated for receiving said curtain, pump means interconnecting one of said passageways and said receptacle, motor means for actuating said pump means, said motor means including valve means for controlling the speed of said motor means to regulate the speed of said pump means, a valve interconnecting the other of said passageways and said receptacle and actuator means for closing said valve when said orifice is open and opening said valve when said orifice is closed; and means for conveying said object through said curtain at a velocity to deposit a layer of the material of predetermined thickness.

14. The curtain coater set forth in claim 13, additionally comprising:

means for changing the rotational direction of said pump means.

15. The curtain coater set forth in claim 1, further comprising:

means carried by said support for moving said movable knife member to regulate the width of said orifice and change the shape of said tubular member.

16. A curtain coater for depositing material onto an object comprising:

a support;

a longitudinally split, resilient, tubular member;

a pair of knife members carried by said tubular member defining an orifice along the split, one of said knife members being attached to said support and the other knife member being movable to adjust the width of said orifice;

means carried by said support for moving said movable knife member to regulate the width of said orifice and change the shape of said tubular member, said means for moving said movable knife member comprising a plurality of fluid pressure actuators carried by said support and having forward piston rods engaging said movable knife member and fluid pump means for actuating said actuators to open and close said orifice;

end closure means carried by said support and in engagement with each end of said tubular member in sealing relationship to form a chamber therein to contain coating material and to accommodate changes in the shape of said tubular member when the width of said orifice is adjusted, said end closure means each having a material passageway therethrough to said chamber;

means for maintaining said chamber substantially full of the coating material to discharge through said orifice at a velocity to form a suitable curtain of the material; and means for conveying said object through said curtain at a velocity to deposit a layer of the material of predetermined thickness.

17. The curtain coater set forth in claim 16, further comprising:

rear piston rods carried by said fluid actuators; and means connected to said rear piston rods for adjusting travel of said rods to adjust the width of said orifice.

18. A curtain coater for depositing material onto an object comprising:

a support;

a longitudinally split, resilient, tubular member;

a pair of knife members carried by said tubular member defining an orifice along the split, one of said knife members being attached to said support and the other knife member being movable to adjust the width of said orifice;

end closure means carried by said support and in engagement with each end of said tubular member in sealing relationship to form a chamber therein to contain coating material and to accommodate changes in the shape of said tubular member when the width of said orifice is adjusted, said end closure means each having a material passageway therethrough to said chamber;

means for maintaining said chamber substantially full of the coating material to discharge through said orifice at a velocity to form a stable curtain of the material;

means for conveying said object through said curtain at a velocity to deposit a layer of the material of predetermined thickness;

a pair of hydraulic actuators, each having a cylinder attached to a supporting structure with a piston rod interconnecting said support adjacent one end of said tubular member;

pump means for supplying fluid under pressure to said actuators;

valve means interconnecting said actuators and said pump means for regulating the flow of said fluid to raise and lower said support and tubular member; and flow divider means interconnecting said valve means and said actuators for dividing said flow of fluid to said actuators.

19. The curtain coater set forth in claim 18, further comprising:

a pair of relief valves connected between said flow divider means and said actuators, respectively, for rendering inactive the leading one of said actuators after that leading one of said actuators reaches a travel limit so as to reestablish longitudinal leveling of said tubular member.

20. The curtain coater set forth in claim 19, further comprising:

a pilot-operated check valve connected between said valve means and said flow divider means for maintaining said tubular member at a predetermined height.

21. The curtain coater set forth in claim 18, further comprising:

resilient means interconnecting each of said piston rods and said support for laterally leveling said tubular member.

22. The curtain coater set forth in claim 18, further comprising:

resilient means for preventing vibration transfer between said support and tubular member.

23. The curtain coater set forth in claim 21, wherein said resilient means comprises:

a plate member;

a member carried by said piston rod and positioned through one end of said plate member and said support;

a first resilient member positioned intermediate said plate member and secured to said support, said piston carried member extending through said resilient member;

a second resilient member secured to the other end of said plate member;

a threaded member having one end portion positioned in said support, and the other end passing through said second resilient member and said plate member; and a nut positioned on said threaded member intermediate said support and said second resilient member for laterally leveling said tubular member when rotated.

24. A pouring head for a curtain coater comprising:

a support;

a longitudinally split, resilient, tubular member;

a pair of knife members carried by said tubular member defining an orifice along the split, one of said knife members being attached to said support and the other being movable to adjust the width of said orifice and to change the shape of said tubular member; and end closure means carried by said support and in engagement with each end of said tubular member in sealing relationship to form a chamber therein to contain coating material and to accommodate changes in the shape of said tubular member when the width of said orifice is adjusted, said end closure means each having a material passageway therethrough to said chamber and comprising a cylinder attached to said support and having an orifice through its end, a movable piston having a tapered portion on one face in said cylinder, said piston and tapered portion having orifices coincident with said orifice in said cylinder to define said passageway and means carried by said cylinder and piston for urging said piston to effect sealing between the piston face and an end of said tubular member around said tapered portion.

25. A pouring head set forth in claim 24, further comprising:

means for aligning said pair of knife members.

26. A pouring head set forth in claim 24, further comprising:

means for preventing excessive pressure in said chamber.

27. A pouring head set forth in claim 24, wherein said end closure means are readily removable from said pouring head.

28. The pouring head set forth in claim 24, wherein said means for urging said piston comprises:

a spring carried by said piston; and a bolt threadedly engaged in the end of said cylinder and having a head abutting said spring.

29. The pouring head set forth in claim 24, further comprising:

distributing means for uniformly distributng coating material throughout the interior length of said tubular member and forming passages with the walls of said tubular member leading to said orifice for reducing turbulence of the coating material.

30. The pouring head set forth in claim 29, wherein said distributing means comprises:

a tube having closed ends positioned within said tubular member throughout its length and above said orifice, the upper quadrant of said tube defining a trough interconnecting said passageways.

31. The pouring head set forth in claim 24, further comprising:

means carried by said support for moving said movable knife member to regulate the width of said orifice and to change the shape of said tubular member.

32. The pouring head set forth in claim 31, wherein said moving means comprises:

fluid pressure actuators carried by said support having movable portions in engagement to move said knife member with the application of fluid pressure.

33. The pouring head set forth in claim 32, further comprising:

manually operable actuator means connected to said movable portions of said fluid pressure actuators for further adjusting the width of said orifice.

34. The pouring head set forth in claim 32, further comprising:

means for enabling said movable knife to be returned to a pre-set distance from said fixed knife when said movable knife is moved from said pre-set distance.

35. The invention as set forth in claim 24, additionally comprising a linear translating means for uniformly regulating the stroke of each of said fluid pressure knife positioning means.

* * * * *